US005885306A

United States Patent [19]

Hamaya et al.

[11] Patent Number: 5,885,306

[45] Date of Patent: Mar. 23, 1999

[54] METHOD FOR PREVENTING REDEPOSITION OF DESORBED DYES TO PRE-DYED FABRICS OR ITS GARMENTS AND DYE ANTIREDEPOSITION AGENT

[75] Inventors: Toru Hamaya; Toshiaki Kono; Masaaki Otsuka, all of Saitama, Japan

[73] Assignees: Meiji Seika Kaisha, Ltd., Tokyo; Rakuto Kasei Industrial Co., Ltd., Shiga, both of Japan

[21] Appl. No.: 905,332

[22] Filed: Aug. 4, 1997

Related U.S. Application Data

[63] Continuation of Ser. No. 595,252, Feb. 1, 1996, abandoned, which is a continuation-in-part of Ser. No. 382,206, Feb. 1, 1995, abandoned.

[30] Foreign Application Priority Data

Feb. 1, 1994 [JP] Japan ..... 6-27580

[51] Int. Cl.[6] ..... D01P 1/50

[52] U.S. Cl. ..... 8/401; 8/561; 8/562; 8/559; 8/918

[58] Field of Search ..... 252/8.57–8.91; 8/559, 561, 401, 562, 442, 495, 115.6; 435/263

[56] References Cited

U.S. PATENT DOCUMENTS

| | | | |
|---|---|---|---|
| 10,308 | 12/1853 | Cook | 8/495 |
| 583,298 | 5/1897 | Bloede | 8/495 |
| 1,378,443 | 5/1921 | Clavel . | |
| 1,870,408 | 8/1932 | Dreyfus et al. | 8/495 |
| 1,870,868 | 8/1932 | Platt | 8/495 |
| 2,288,432 | 6/1942 | Billing | 8/495 |
| 3,748,092 | 7/1973 | Mercer | 8/74 |
| 3,905,762 | 9/1975 | Lehinant et al. | 8/543 |
| 4,443,355 | 4/1984 | Murata et al. | 252/174.12 |
| 4,531,946 | 7/1985 | Christie et al. | 8/192 |
| 4,761,161 | 8/1988 | Potschke | 8/543 |
| 5,318,905 | 6/1994 | Saito et al. | 435/209 |
| 5,380,447 | 1/1995 | Kirk et al. | 8/442 |
| 5,435,809 | 7/1995 | Holst et al. | 8/401 |

FOREIGN PATENT DOCUMENTS

| | | |
|---|---|---|
| 0 018 775 | 11/1980 | European Pat. Off. . |
| 0 422 683 | 4/1991 | European Pat. Off. . |
| 774 569 | 12/1934 | France . |
| 78 27707 | 4/1979 | France . |
| 502550 | 7/1930 | Germany . |
| WO 90/02790 | 3/1990 | WIPO . |

OTHER PUBLICATIONS

Hawley's Condensed Chemical Dictionary p. 108 revised 1987.

Grant & Hackh's Chemical Dictionary, 1987 p. 145.

*Primary Examiner*—Margaret Einsmann

*Attorney, Agent, or Firm*—Sughrue, Mion, Zinn, Macpeak & Seas, PLLC

[57] ABSTRACT

A method for preventing redeposition of desorbed dyes to pre-dyed fabrics or its garments, which comprises adding colloid at the treatment of pre-dyed fabrics or its garments. A dye antiredeposition agent to be used at the treatment of pre-dyed fabrics or its garments, which contains a colloid in an amount of 0.4 g or more per 500 avicelase units of cellulose. The present invention has rendered possible simple and efficient prevention of redeposition of dyes at the time of the treatment of pre-dyed fabrics or its garments. Especially, when an enzyme is used in the treatment, adverse influenced upon the enzyme is characteristically small.

14 Claims, No Drawings

METHOD FOR PREVENTING REDEPOSITION OF DESORBED DYES TO PRE-DYED FABRICS OR ITS GARMENTS AND DYE ANTIREDEPOSITION AGENT

U.S. Ser. No. 08/905,332 is a continuation of 08/595,252, filed Feb. 1, 1996, now abandoned, in turn a continuation-in-part of 08/132,206 filed Feb. 1, 1995, now abandoned.

FIELD OF THE INVENTION

This invention relates to a method for preventing redeposition of desorbed dyes (desorption of dyes as redeposited to fabrics is also included hereinafter) to pre-dyed fabrics or its garment and a dye antiredeposition agent which prevents redeposition of desorbed dyes to fabrics or its garments at the time of treating pre-dyed fabrics or its garments.

BACKGROUND OF THE INVENTION

The following phenomena occur when woven cloth which is with dyed yarn and undyed yarn, such as denim cloth or the like, is subjected to desizing, enzymatic weight reducing treatment or the like processing.

When desizing is carried out, a desorbed dye redeposits to the bleached yarn to cause staining of the white area. When enzymatic weight reducing treatment is carried out, a desorbed dye redeposits not only to the bleached yarn to cause staining of the white area but also to the stripped area (white area) of the top-dyed yarn, thus reducing quality of the product considerably.

There is a treatment in which its garments dyed with not only the indigo denim dye but also other dyes are washed using a washer with the joint use of pumice, enzymes and the like to create a washed out and faded also worn-out feeling, and such a treatment also causes redeposition of desorbed dyes and reduction of the quality.

With the aim of preventing the staining of white areas and redeposition of dyes, a number of materials have been developed but with no success in resolving the above problems.

For example, CMC (carboxymethylcellulose) sodium, poval, polyvinyl pyrrolidone and the like have been known from old times. Examples of such materials so far disclosed in patents include calcium chloride (JP-A 46-330; the term "JP-A" as used herein means an "unexamined published Japanese patent application"), sodium polyacrylate (JP-A 48-64283), nonionic type surface active agent (JP-A 50-18786), mixture of β-naphthol and ethylene oxide (JP-A 55-22081), α-olefin sulfonate (JP-A 56-53274), water soluble high polymer whose carboxyl groups are partially or entirely made into salt (JP-A 56-63081), copolymer of maleic anhydride with isoamylene and/or amylene (JP-A 58-41981), specified organosilane and organosiloxane (JP-A 58-70774), specified aromatic sulfonic acid condensate and oil (JP-A 60-45676), a water soluble copolymer containing unsaturated carboxylic acids and a formalin condensate of a specified polycyclic aromatic compound sulfonate (JP-A 61-215769), a vinyl polymer having a pyrrolidone skeleton or a copolymer of vinyl pyrrolidone with other monomer (JP-B 5-61395; the term "JP-B" as used herein means an "examined Japanese patent publication"), specified diquaternary ammonium salt and mono-, poly-quaternary or specified polymer-ammonium salt or unquaternarized basic nitrogen-containing polycondensates (JP-A 62-117887), organic sulfonic acid and/or its salts (JP-A 63-135581), synthetic detergent active component, vinyl pyrrolidone polymer and nonionic cellulose ester (JP-A 63-37200), significantly insoluble trapping agent (JP-W 63-502761; the term "JP-W" as used herein means an "unexamined published Japanese international patent application"), cationic cellulose (JP-A 1-201588), polyalkylene oxide-based graft polymer (JP-A 63-260994), water soluble salts of polymerized fatty acids (JP-A 1-272888), specified water soluble polymers (JP-A 1-185398) and the like. In addition, a method in which the prevention is effected by controlling the treatment conditions and a method in which redeposition of dyes and stains is reduced by processing the surface of fabrics have also been developed.

However, when mediums such as surface active agents and the like are used as one of such prior art findings, they cause environmental problems such as water pollution and the like, or a mixture of a desorbed dye and a surface active agent redeposits to fabrics in some cases. The invention in which canonized cellulose is used (JP-A 01-201588) contemplates overcoming such problems but is highly costly, because it is necessary to cationize cellulose at a ratio of 100 to 3,000 milli equivalent/kg fabric.

Also, when the dye of interest is anionic and disperse type, it is necessary to anionize with an anionic dispersing agent. More disadvantageously, when an enzyme is present in the washing, the enzyme itself becomes anion under general washing conditions and therefore is electrically adsorbed by cationic cellulose, thus entailing reduction of its effect.

On the other hand, an attempt has been made to use an insoluble adsorbent for pigments and/or fat soils but on condition that washing should be effected under application of ultrasonic wave (JP-W 63-502761). Since this method is also characterized by the cationization treatment of polyquaternary ammonium compounds and the like, it has problems similar to the case of the aforementioned catonized cellulose. In addition, though there is a case in which effects of a nonionic cellulose ester are found by the combined use of other mediums (JP-A 63-37200), carboxymethylcellulose as a representative of the cellulose ester itself is already known in the art and the method has a problem similar to the case of the aforementioned canionized cellulose in terms of the necessity to carry out etherification.

SUMMARY OF THE INVENTION

According to the present invention, there is provided a method-for preventing redeposition of desorbed dyes to pre-dyed fabrics or its garments, which comprises adding colloid at the treatment of pre-dyed fabrics or its garments. Another object of the present invention is to provide a dye antiredeposition agent to be used at the treatment of pre-dyed fabrics or its garments, which contains a colloid in an amount of 0.4 g or more per 500 avicelase units of cellulose.

Other objects and advantages will be made apparent as the description progresses.

DETAILED DESCRIPTION OF THE INVENTION

The present invention will be described in detail as follows.

In recent years, a variety of enzyme preparations have been used in the processing and washing of fabrics. Because of this, additive agents to be used at the time of the treatment and washing should have smaller influences upon enzymes, such as reduction of their activities. The method and the dye antiredeposition agent of the present invention are characterized by a colloid.

Origins of the colloid may be organic substances such as cellulose and the like or inorganic substances. Colloid is generally defined as "a dispersed system or dispersed phase in which a substance is dispersed as particles having a size larger than atoms or low molecules" ("Physical and Chemical Dictionary", Iwanami Shoten). According to the present invention, the following substances can be used as a colloid when its particles are in a dispersed state.

1) Inorganic colloids:

Calcium carbonate silicon oxide, titanium oxide and the like are particularly preferred. Particle diameter of calcium carbonate used in the present invention is preferably small, more preferably 1 μm or smaller such as Softon 3200 (Bihokufunka Kogyo K. K. ). Specific examples of silicon oxide used in the present invention include Nipsil K-300 (Nippon Silica K. K. ). Particle diameter of titanium oxide used in the present invention is preferably small, more preferably 1 μm or smaller such as TITANIX MT-600B (Teika K. K. ).

2) Organic colloids:

Cellulose is particularly preferred. Cellulose to be used in the present invention may partly contain xylan or the like hemicellulose, lignin and the like. When a cellulose-derived colloid is used, it is important to reduce molecular weight of cellulose in order to increase its dispersibility. The molecular weight reduction is conventionally effected by forming a colloid making use of a physical crushing, chemical decomposition, biological decomposition or the like method. An organic colloid having a 1 μm or smaller particle diameter is preferably used in the present invention, such as Avicel RC-N91, Avicol RC-N30(microcrystalline cellulose available from Asahi Kasei Kogyo K. K. ) and Celish (micronized cellulose available from Daicel Kagaku Kogyo K. K. ). Besides, soybean cake and cotton seed cake can be used in the present invention.

3) Colloid prepared by coating the surface of the above-mentioned inorganic or organic colloid with one or more water soluble polymers to increase the dispersibility;

The water soluble polymers are selected from the group consisting of cellulose ether, cellulose ester, starch ether, starch ester, locust bean gum, guar gum, tamarind gum, quince seed gum, gum arabi, tragacanth gum, karaya gum, ghatti gum, arabinogalactan, agar, alginic acid salt, carrageenan, furcellaran, laminarin, pectin, xanthan gum, curdlan and pullulan. An example of preparation methods for these high dispersible colloids was described in JP-B-57-14771, while the preparation method is not particularly limited. Examples of commercially available products of colloid of this type include Avicel CL-611 and Avicel RC-591 (coated microcrystalline cellulose available from Asahi Kasei Kogyo K. K. ).

4) Colloid prepared by introducing a hydrophilic group into a portion of a water insoluble polymer, or introducing a hydrophobic group into a portion of a water soluble polymer may also agree with the objects of the present invention:

Examples of the colloid prepared by introducing a hydrophilic group into a portion of a water insoluble polymer are cellulose ether, cellulose ester and the like.

Examples of cellulose ether are carboxymethylcellulose, methylcellulose, ethylcellulose, cyanoethylcellulose, hydroxyethylcellulose, hyroxypropylcellulose, ethylhydroxycellulose, hydroxypropylmethylcellulose and the like. Examples of cellulose ester are cellulose nitrate, cellulose sulfate, cellulose acetate, cellulose acetate butylate and the like. These cellulose ethers and cellulose esters are preferably insolubilized partially by regulating their substitution degrees.

Especially, a carboxymethylcellulose having an avarage substitution degree of 0.4 or lower shows an excellent effect as compared with a carboxymethylcellulose having an avarage substitution degree of 0.5 or higher which is used for a general detergent.

On the other hand, preferable examples of the colloid prepared by introducing a hydrophobic group into a portion of a water soluble polymer, include a polyglutamic acid polymer 50% of which is introduced by benzyl group with ester bond.

Collagen (U.S. Pat. No 3,748,092), glue, gelatin (U.S. Pat. No. 1,870,868), milk protein (U.S. Pat. No. 4,761,161) and gelatin (U.S. Pat. No. 1,378,443) and the like are used for prevention of rubbing or crocking of dyes, prevention of color dull of pre-dyed yarn at sizing or desizing step, reduction of the amount of phosphoric acid as a component of detergent for woven and increase of the deposit ability of dyes to acetic acid cellulose. These effects are clearly different from that of the present invention. Futher, the colloid prepared by introducing a hydrophobic group into a portion of a water soluble polymer shows an excellent effect of the present invention as compared with these protein colloids.

Examples of the pre-dyed fabrics or its garments according to the present invention include cotton, hemp, linen and ramie, viscose rayon, polynosic rayon, cuprammonium rayon, Tencel (manufactured by Courtaulds), etc. and the like cellulose fabrics or its garments thereof, as well as its blended or union fabrics or garments, preferably denim woven fabrics or sewings thereof.

Examples of dyes include a direct dye, a reactive dye, an acid dye, a mordant/acid mordant dye, a vat dye, a sulfur dye, an azoic dye, a pigment and the like, and the dyed fabrics or its garments are those which are dyed with these dyes in the ordinary methods.

Though the term "treatment" means desizing and weight reducing treatments, the present invention can be applied also to scouring, reform processing and the like treatments. In this connection, it is known that cellulase, amylase, protease, lipase, pectinase and the like enzymes are used in these treatments (*Dyeing Industry*, vol.3B, no. 8, p.47).

When fabrics or its garments dyed with the aforementioned dyes are subjected to the aforementioned treatments, desorbed dyes stain the surface of fabrics (white area staining) to cause considerable decrease in the quality. For example, in the case of blue jeans as mixed weave products of dyed yarn and undyed yarn (bleached yarn), the bleached yarn is stained blue (white area staining) so that the general color tone shows a faded impression. In addition, a part such as pocket cloth or the like which should be white by origin is dyed to cause reduction of the quality. Even when the staining of white area does not cause a problem, redeposition of desorbed dyes becomes a cause of the reduction of apparent stripping (decoloring) efficiency.

The present invention resolves these problems involved in the prior art by allowing a colloid to coexist at the time of the treatment thereby preventing or reducing redeposition of dyes.

Though there is no particular limitation on additive agents to be used in the present invention, effect of the present invention becomes remarkable when cellulose or the like enzyme is used at the time of the treatment because of the absence of adverse influences such as inactivation of the enzyme.

Amount of colloid to be added may be decided based on the liquor ratio (weight ratio of fabrics and washing liquid), treatment temperature (usually 40° to 80° C.), treatment method and the like, When cost is taken into consideration, the adding amount should naturally be limited to the minimum within the sufficiently effective range. The adding amount can be reduced by increasing the liquor ratio. According to the present invention, though the amount of colloid used in the method, or contained in the dye antiredeposition agent is not limited, it is preferably 0.4 g or more, more preferably 0.4 to 20 g, still more preferably 0.6 to 10 g per 1 liter treatment liquor. When the amount of colloid in the treatment liquor is 0.4 g/l or more, the liquor latio is preferably 1:100 to 1:3.

When the enzyme is added at the treatment of pre-dyed fabrics or its garments, the enzyme is chosen on the purpose (for example, amylase for desizing, cellulase or protease for weight reducing). A buffering agent for adjusting pH value such as phosphorates, acetates, citrates and the like, and a builder for improving detergency such as aluminosilicates, silicates, carbonates and the like can be combinely used with the colloid and the enzyme. On the other hand, after mixing the colloid with these additives, the present colloid can be prepared to granule or liquid preparation for use.

When the enzyme is cellulase, avicelase activity is used for one of the index of enzyme activity. Avicelase activity used for the present invention is determined by the following method.

A 2%(w/v) suspension of microcrystalline cellulose (Avicol SFT™, manufactured by Asahi Kaeoi Kogyo K. K.) in distilled water is used as a substrate suspension. After 2.0 ml of a 0.05M buffer adjusted to pH 4.5 for acidic cellulase or pH 7.0 for neutral cellulose is added to 2.5 ml of the substrate suspension, the mixture is placed in an L-shaped test tube (a round bottom). The test tube is maintained at a measuring temperature for 10 mim.

A enzyme sample to be analyzed is dissolved in distilled water. 0.5 ml of the solution is added to the above test tube. The test tube is accurately shaken at a shaking rate of 60 times/min for 30 min by means of a Monod type shaker while maintaining the test tube at 50° C., thereby allowing a reaction to proceed. Thereafter, 0.5 ml of a 0.5N sodium hydroxide solution is added thereto to stop the reaction.

Separately, 0.5 ml of a 0.5N sodium hydroxide solution is added to a solution of the same kind as described above before the reaction to inhibit the progress of the reaction. This solution is used as a control.

After stopping the reaction, the reaction mixture is centrifuged (3000 rpm×10 min). The reducing sugar content of the supernatant is measured by the following DNS (3,5-dinitrosalicylic acid) method. The DNS reagent is prepared according to a method specified in IUPAC.

A short test tube (18 mmϕ×130 mm) is charged with 0.5 ml of the supernatant is placed as a sample and then 1.5 ml of a DNS reagent solution. The test tube is allowed to stand in boiling water for 5 min while preventing evaporation by a glass cap to heat the test tube, thereby developing a color. After the reaction mixture is sufficiently cooled with running water, 4 ml of distilled water is added thereto. Then, the absorbance (540 nm) of the mixture is measured.

The reducing sugar content of the reaction mixture can be read from a calibration curve. The calibration curve is prepared using glucose anhydride (guaranteed reagent) in concentrations of 0, 0.2, 0.4, 0.6, 0.8 and 1.0 mg/ml.

This calibration curve is used to determine the difference in reducing sugar content between the sample and the control. The difference is regarded as the formed reducing sugar content.

The Avicelase activity (U/g) can be determined from the formed reducing sugar content and the enzyme content of the enzyme sample solution used in the reaction according to the following equation:

$$\text{Avicelase activity (U/g)} = \frac{\text{formed reducing sugar content (mg)}}{\text{enzyme content (mg)}} \times 11 \times 1000 \times 1000/180/30$$

(1U/g = 1 μmol/min/g)

When the cellulase is used in the method of the present invention, or contained in the dye antiredeposition agent of the present invention, the amount of cellulase may be 10 to 5000, preferably 20 to 2000, more preferably 50 to 500 avicelase units per 0.4 g of the colloid.

The colloid of the present invention may be added at the time of the ordinary treatment, and the effect may be improved in some cases when a plurality of colloids are jointly used depending on the used temperature, pH, additive agents and the like. The dye antiredeposition agent of the present invention can be used jointly with a surface active agent, a builder, an enzyme, an antiseptic agent and the like. In addition, the small influence upon environment is also one of the important features of the present invention.

The following examples are provided to further illustrate the present invention. It is to be understood, however, that the examples are for purpose of illustration only and are not intended as a definition of the limits of the invention.

INVENTIVE EXAMPLE 1

A blue jeans woven fabric after desizing was subjected to a stripping treatment under the following conditions.

Stripping conditions

Testing machine: 8 liter capacity small washer

Liquor ratio : 1:100

Heating : 55° C.

Time : 60 minutes

The treatment was carried out by adding a neutral cellulase in 50 units as Avicelase and 0.6 g of a dye antiredeposition agent (shown in Table 1) per 1 liter treatment bath. After the treatment, washing and drying were carried out. As the results, as shown in Table 1, staining-preventing effect was observed with no decrease in the stripping effect. In this instances L value (lightness, represents brightness and becomes white as it comes close to 100; light source, D-65) of the front side of the blue jeans woven fabric was measured by Lab system, and difference between the values of the treated and untreated fabrics was used to express the degree of stripping. In the same manner, WB value (brightness by Hunter, represents whiteness; light source, C/2) of the cotton knit added at the time of the treatment was measured by Lab system, and difference between the values of the treated and untreated knits was used to express the degree of staining.

TABLE 1

Effects of dye antiredeposition agent

| Additive Agent | Stripping (Δ L) | Staining (Δ WB) | Kind** |
|---|---|---|---|
| No addition | good, 1.36 | yes, −6.09 | |
| Avicel CL-611 | good, 1.35 | no, 1.63 | 3) |
| Avice1 CL-591 | good, 1.34 | no, 1.38 | 3) |
| CMC (etherification | | | |

TABLE 1-continued

Effects of dye antiredeposition agent

| Additive Agent | Stripping (Δ L) | Staining (Δ WB) | Kind** |
|---|---|---|---|
| degree, 0.2) | good, 1.32 | no, 1.48 | 4) |
| Polyglutamic acid* | good, 1.36 | no, −0.55 | 4) |
| Cellulose (Celish) | good, 1.30 | no, 1.27 | 2) |
| Soybean cake | good, 1.50 | no, 0.01 | 2) |
| Cotton seed cake | good, 1.48 | no, 0.12 | 2) |
| $CaCO_3$ colloid (Softon 3200) | good, 1.37 | no, −0.94 | 1) |
| Silicon oxide (Nipsil K-300) | good, 1.33 | no, −1.05 | 1) |
| Titanium oxide (TITANIX MT-600B) | good, 1.38 | no, −0.55 | 1) |

*: benzyl esterification degree, 50%

**: Kind of colloid in accordance with the definition of the present invention.

In Table 1, higher than −3 of Δ WB, −5 to −3 of Δ WB and lower than −5 of Δ WB mean "No staining", "Slightly staining" and "Staining", respectively.

INVENTIVE EXAMPLE 2

Blue jeans pants after desizing was subjected to a stripping treatment under the following conditions.

Stripping conditions

Testing machine: 40 kg washer

Liquor ratio : 1:7

Heating:55° C.

Time: 60 minutes

The treatment was carried out by adding a neutral cellulase in 50 units as Avicelase and 0.6 g of a dye antiredeposition agent per 1 liter treatment bath. After the treatment, washing, sodium hypochlorite treatment, washing, sodium thiosulfate treatment, washing and drying were carried out in that order. As the results, as shown in Table 2, staining-preventing effect was observed with no decrease in the stripping effect.

TABLE 2

Effects of dye antiredeposition agent

| Additive Agent | Stripping (Δ L) | Staining (Δ WB) |
|---|---|---|
| No addition | good, 3.8 | yes, −8.05 |
| Avicel CL-611 | good, 3.9 | no, 0.26 |
| Soybean cake | good, 4.1 | no, 0.21 |

INVENTIVE EXAMPLE 3

The treatment of Inventive Example 1 was repeated except that an acid cellulase was used in an amount of 500 avicelase units per liter. Avicel CL-611 was used as a dye antiredeposition agent in an amount of 0.2, 0.4 or 0.6 g/liter. As the results, in comparison with the case of no addition, when Avicel CL-611 was used in an amount of 0.4 or 0.6 g/liter, redeposition of the dye was markedly prevented with almost the same degree of stripping, though the effect was not shown when the amount of the Avicel CL-611 was 0.2 g/liter.

INVENTIVE EXAMPLE 4

The neutral cellulase was mixed with Avical CL-611 in an amount of 0.2 to 0.6 g per 50 avicelase units of the enzyme, and the mixture was made into granules. When the treatment of Inventive Example 1 was carried out using the granules, an effect similar to the case of the 0.6 g-added result in Inventive Example 1 was obtained by the addition of 0.4 g.

INVENTIVE EXMAPLE 5

A jumper and pants made of Tencel (manufactured by Courtaulds), both of which have been dyed with indigo and subjected to desizing, were treated using an acid cellulase (100 avicelase units/l) under the following conditions.

Testing machine: 40 kg washer

Liquor ratio: 1:20

Heating: 55° C.

Time: 60 minutes

Balls *: Power ball L 200% Special ball S 200%

*: rubber balls to be used jointly at the time of the treatment, manufactured by Rakuto Kasei Industrial Co., ltd.

As the results, redeposition of the dye was strong with a weight loss ratio of 4.7% when the enzyme was used alone, while redeposition of the dye was not observed with a weight loss of 4.3% when CMC having an etherification degree of 0.2 was added in an amount of 0.6 g/liter. Also, redeposition of the dye was not observed with a weight loss of 4.6% when Avicel CL-611 was added in an amount of 0.6 g/liter.

INVENTIVE EXAMPLE 6

The treatment of Inventive Example 5 was repeated except that the cellulose was not added. As the results, redeposition of the dye was strong with a weight loss ratio of 1.2%, while redeposition of the dye was not observed with a weight loss of 1.2% when Avicel CL-611 was added in an amount of 0.6 g/liter.

INVENTIVE EXAMPLE 7

Blue jeans pants was subjected to a desizing treatment under the following conditions.

Desizing conditions

Testing machine: 15 liter drum washer

Liquor ratio: 1:50

Heating: 80° C.

Time: 20 minutes

The treatment was carried out by adding amylase (PAS-600, manufactured by RAKUTO KASEI INDUSTRIAL CO., LTD.) and 0.6 g of Colloidal Avicel CL-611 per 1 liter treatment bath. After the treatment, washing and drying were carried out. As the results, in comparison with the case of no addition, redeposition of the dye was markedly prevented with almost the same degree of desizing.

Thus, the present invention has rendered possible simple and efficient prevention of redeposition of dyes at the time of the treatment of pre-dyed fabrics or its garments. Especially, when an enzyme is used in the treatment, adverse influences upon the enzyme is characteristically reduced.

While the invention has been described in detail and with reference to specific examples thereof, it will be apparent to one skilled in the art that various changes and modifications can be made therein without departing from the spirit and scope thereof.

What is claimed is:

1. A method for preventing redeposition of desorbed dyes to pre-dyed fabrics or garments made therefrom during a treatment of the fabric or garment in a textile liquor, which comprises carrying out the treatment in the presence of a cellulose derived colloid existing in said liquor in an amount of 0.4 g or more per 1 liter of said treatment liquor.

2. The method according to claim 1, wherein said predyed fabrics or its garments are denim woven fabrics or sewings thereof.

3. The method according to claim 1, wherein said cellulose derived colloid is added in the presence of an enzyme at the treatment.

4. The method according to claim 3, wherein said enzyme is cellulase.

5. The method according to claim 2, wherein said cellulose derived colloid is added in the presence of an enzyme at the treatment.

6. The method according to claim 1, wherein the surface of the cellulose derived colloid has been coated with at least one water-soluble polymer to increase the dispersibility of the colloid.

7. The method according to claim 1, wherein said cellulose derived colloid has been prepared by introducing a hydrophilic group into a portion of cellulose.

8. The method according to claim 1, wherein said cellulose has a 1 $\mu$m or smaller particle diameter.

9. The method according to claim 1, wherein said cellulose derived colloid is a carboxymethylcellulose having an average substitution degree of 0.4 or lower.

10. The method according to claim 8, wherein said cellulose having a 1 $\mu$m or smaller particle diameter is at least one selected from the group consisting of soybean cake and cotton seed cake.

11. The method according to claim 1, wherein said water-soluble polymer is at least one selected from the group consisting of cellulose ether, cellulose ester, starch ether, starch ester, locust bean gum, guar gum, tamarind gum, quince seed gum, gum arabi, tragacanth gum, karaya gum, ghatti gum, arabinogalactan, agar, alginic acid salt, carrageenan, furcellaran, laminarin, pectin, xanthan gum, curdlan and pullulan.

12. The method according to claim 7, wherein said cellulose derived colloid prepared by introducing a hydrophilic group into a portion of cellulose is cellulose ether or cellulose ester.

13. The method according to claim 12, wherein said cellulose ether is at least one selected from the group consisting of carboxymethylcellulose, methylcellulose, ethylcellulose, cyanoethylcellulose, hydroxyethylcellulose, hydroxypropylcellulose, ethylhydroxycellulose and hydroxypropylmethylcellulose, and said cellulose ester is at least one selected form the group consisting of cellulose nitrate, cellulose sulfate, cellulose acetate and cellulose acetate butylate.

14. The method according to claim 9, wherein said cellulose derived colloid is a carboxymethylcellulose having an average substitution degree 0.2.

* * * * *